US011621464B2

(12) United States Patent
Chen et al.

(10) Patent No.: US 11,621,464 B2
(45) Date of Patent: Apr. 4, 2023

(54) WAVEGUIDE ASSEMBLY

(71) Applicant: Hughes Network Systems, LLC, Germantown, MD (US)

(72) Inventors: Guo Chen, Damascus, MD (US); Ed Lott, Frederick, MD (US); Jessica Brockett, Silver Spring, MD (US)

(73) Assignee: HUGHES NETWORK SYSTEMS, LLC, Germantown, MD (US)

( * ) Notice: Subject to any disclaimer, the term of this patent is extended or adjusted under 35 U.S.C. 154(b) by 177 days.

(21) Appl. No.: 17/138,384

(22) Filed: Dec. 30, 2020

(65) Prior Publication Data

US 2022/0209381 A1 Jun. 30, 2022

(51) Int. Cl.

| | |
|---|---|
| ***H01P 1/207*** | (2006.01) |
| ***H01P 1/202*** | (2006.01) |
| ***H01P 1/213*** | (2006.01) |
| ***H01P 1/20*** | (2006.01) |

(52) U.S. Cl.

CPC ..... *H01P 1/202* (2013.01); *H01P 1/2002* (2013.01); *H01P 1/207* (2013.01); *H01P 1/2133* (2013.01)

(58) Field of Classification Search

CPC ..... H01P 1/20; H01P 1/201; H01P 1/2002; H01P 1/202; H01P 1/2133; H01P 1/207; H01P 1/208; H01P 1/2082; H01P 1/211; H01P 5/103

See application file for complete search history.

(56) References Cited

U.S. PATENT DOCUMENTS

| | | | | |
|---|---|---|---|---|
| 8,947,177 | B2 | 2/2015 | Kokkinos | |
| 10,498,000 | B2 | 12/2019 | Hadavy et al. | |
| 2006/0139129 | A1 | 6/2006 | Mueller et al. | |
| 2010/0308925 | A1 * | 12/2010 | Song | H01P 1/2088 438/694 |
| 2020/0388899 | A1 | 12/2020 | Yung et al. | |

OTHER PUBLICATIONS

International Search Report and Written Opinion dated Mar. 24, 2022 in corresponding International Application No. PCT/US2021/065299.

* cited by examiner

*Primary Examiner* — Stephen E. Jones
(74) *Attorney, Agent, or Firm* — Global IP Counselors, LLP

(57) ABSTRACT

A waveguide assembly is disclosed herein. In an embodiment, a waveguide assembly includes a circuit board, a housing and a waveguide filter channel. The circuit board has at least one waveguide interface formed from an electrically conductive material. The housing is configured to be attached to the circuit board so as to align with the at least one waveguide interface. The waveguide filter channel is formed between the circuit board and the housing, with the circuit board and the housing each forming at least a portion of the waveguide filter channel. The waveguide filter channel is configured to at least one of (i) receive a radio frequency signal from the at least one waveguide interface or (ii) output the radio frequency signal to the at least one waveguide interface.

20 Claims, 10 Drawing Sheets

WAVEGUIDE ASSEMBLY

BACKGROUND

Field of the Invention

The present disclosure generally relates to a waveguide assembly for use with electromagnetic waves. In particular, the present disclosure relates to a radio frequency ("RF") waveguide assembly which integrates a waveguide filter channel into an RF shield that is attached to a circuit board.

Background Information

There are several known methods of constructing circuit boards with waveguide filters, but these methods are typically expensive, require numerous separate components, and/or do not achieve high tolerances. One known method is to use a strip line waveguide filter which is printed on the circuit board. Another known method is to use a waveguide filter with metal walls. Yet another known method is to mount a waveguide filter on the circuit board using a waveguide filter assembly that is separate component from the circuit board and an RF shield.

SUMMARY

It has been discovered that an improved waveguide assembly and method of constructing circuit boards with waveguide filters is desired. For example, it has been determined that strip line waveguide filters typically have high loss, require a large area of the circuit board, and are sensitive to circuit board process tolerances for high frequencies. Waveguide filters with metal walls have a high cost and are difficult to assemble. Waveguide filters with separate RF shields need to be large to accommodate the separate waveguide filter component, making the overall assembly bulkier and unsuitable for low cost implementations, and further increasing the cost and complexity.

The present disclosure provides an improved waveguide assembly that has a compact design, is simple and inexpensive to construct, uses fewer components than prior designs, and achieves high performance tolerances. More specifically, the waveguide assembly of the present disclosure integrates the waveguide filter into an RF shield, and utilizes two zero z-axis patch waveguide launches as transitions from the circuit board to the RF shield which is embedded with the waveguide filter.

In view of the state of the known technology, one aspect of the present disclosure is to provide a waveguide assembly including a circuit board, a housing and a waveguide filter channel. The circuit board has at least one waveguide interface formed from an electrically conductive material. The housing is configured to be attached to the circuit board so as to align with the at least one waveguide interface. The waveguide filter channel is formed between the circuit board and the housing, with the circuit board and the housing each forming at least a portion of the waveguide filter channel. The waveguide filter channel is configured to at least one of (i) receive a radio frequency signal from the at least one waveguide interface or (ii) output the radio frequency signal to the at least one waveguide interface.

Another aspect of the present disclosure is to provide a waveguide assembly including a circuit board and a housing. The circuit board has at least one waveguide interface and at least one air cavity. The at least one waveguide interface is formed from an electrically conductive material and is configured to launch or receive a radio frequency signal. The at least one air cavity is aligned with the at least one waveguide interface. The housing forms at least a portion of a waveguide filter channel therein. The housing is attached to the circuit board such that the at least one waveguide interface is located between the waveguide filter channel and the at least one air cavity.

Another aspect of the present disclosure is to provide a waveguide assembly including a circuit board and a housing. The circuit board has a first waveguide interface formed from an electrically conductive material and a second waveguide interface formed from an electrically conductive material. The first waveguide interface is separated from the second waveguide interface on a surface of the circuit board. The housing forms at least a portion of a waveguide filter channel therein. The housing is attached to the circuit board such that the waveguide filter channel is aligned with the first waveguide interface and the second waveguide interface to place the first waveguide interface in signal communication with the second waveguide interface such that a radio frequency signal can be transmitted from the first waveguide interface to the second waveguide interface.

Also, other objects, features, aspects and advantages of the disclosed waveguide systems and methods will become apparent to those skilled in the art in the field of RF signals from the following detailed description, which, taken in conjunction with the annexed drawings, discloses preferred embodiments of a waveguide assembly with various features.

BRIEF DESCRIPTION OF THE DRAWINGS

Referring now to the attached drawings which form a part of this original disclosure.

DETAILED DESCRIPTION OF EMBODIMENTS

Selected embodiments will now be explained with reference to the drawings. It will be apparent to those skilled in the art from this disclosure that the following descriptions of the embodiments are provided for illustration only and not for the purpose of limiting the invention as defined by the appended claims and their equivalents.

Figure 1:
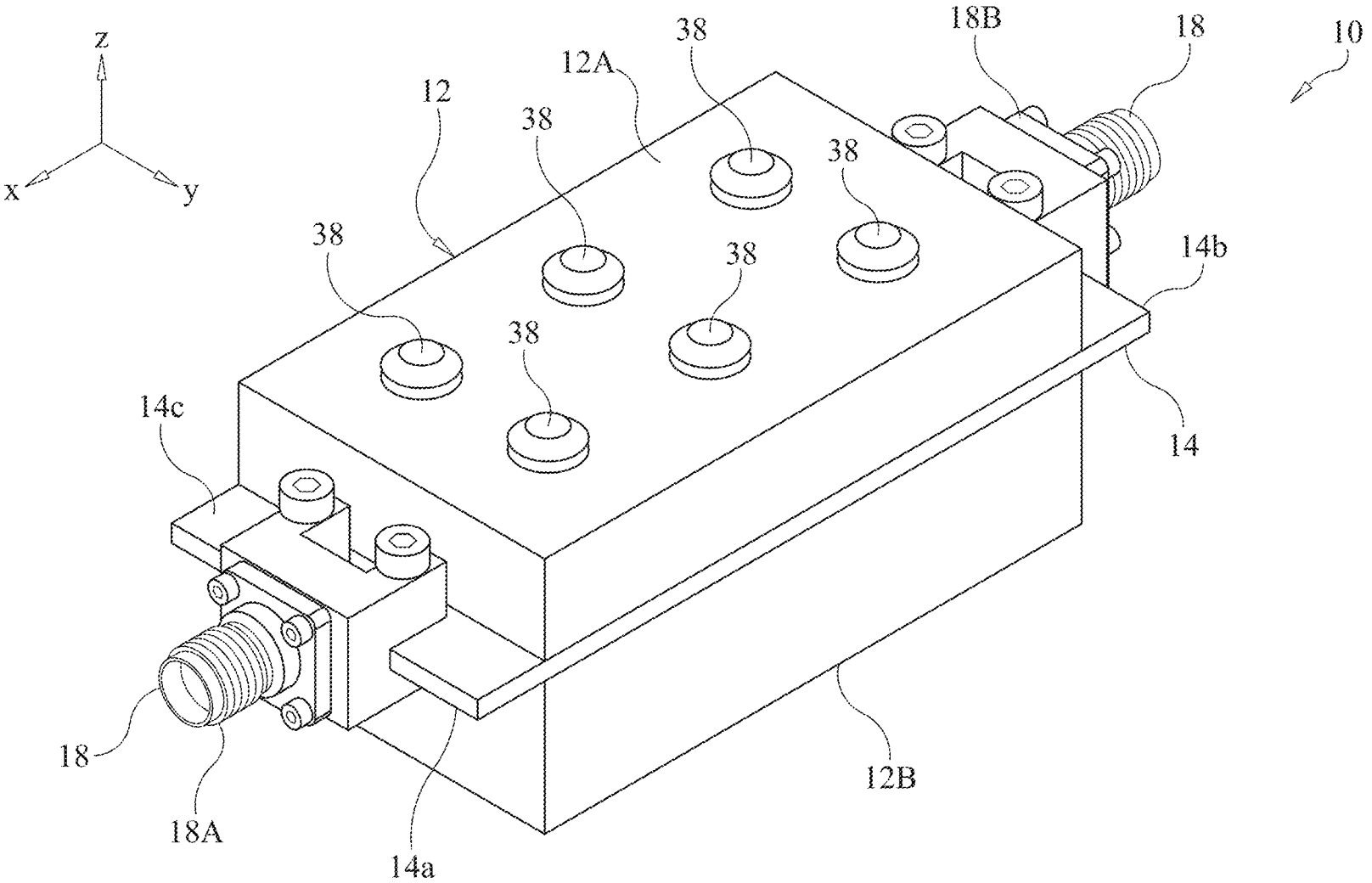
FIG. 1 illustrates a top perspective view of an example embodiment of a waveguide assembly according to the present disclosure.

FIG. 1 illustrates an example embodiment of a waveguide assembly 10 in accordance with the present disclosure. The waveguide assembly 10 is configured to transmit an electromagnetic wave. More specifically, the waveguide assembly 10 is configured to transfer a radio frequency ("RF") signal. It should be understood from this disclosure that the shapes, sizes and dimensions of the components of the waveguide assembly 10 will vary depending on the frequency of the RF signal to be transmitted and/or the intended application.

Figure 5:
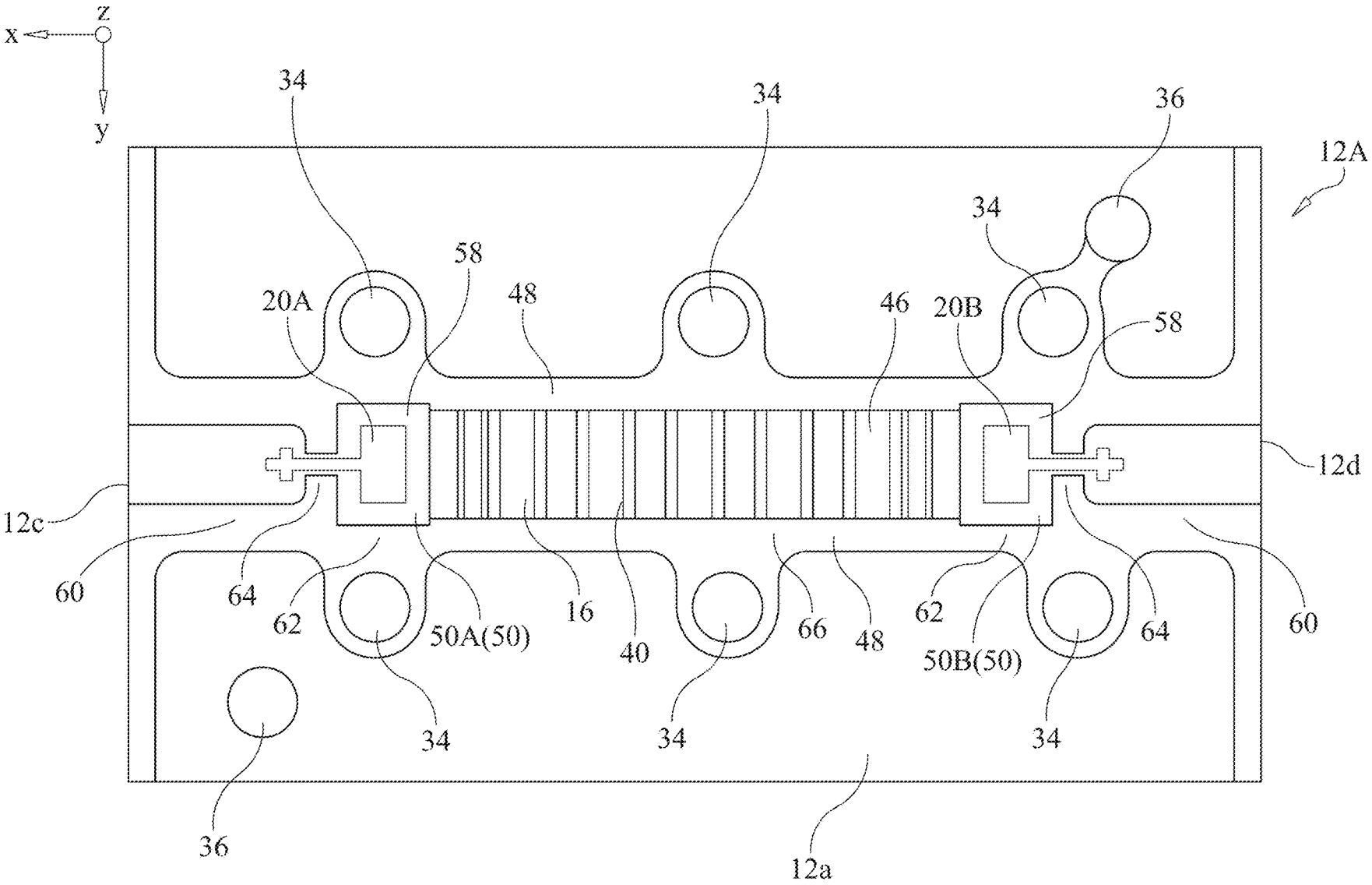
FIG. 5 illustrates a bottom plan view of the first housing of FIG. 4.
Figure 6:
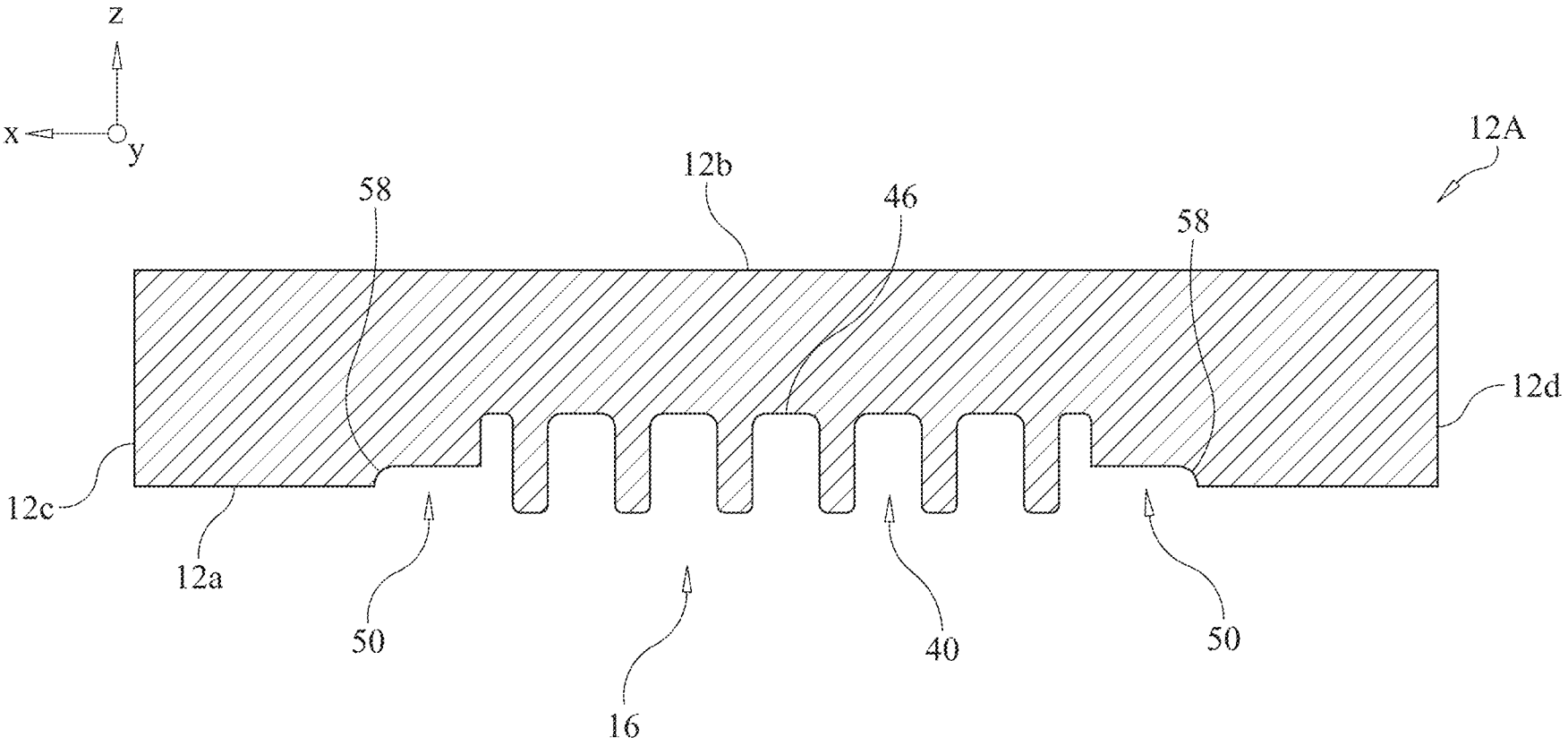
FIG. 6 illustrates a cross-sectional side view of the first housing of FIG. 4 taken across lines VI-VI in FIG. 4.

The waveguide assembly 10 includes a housing 12 and a circuit board 14. The housing 12 includes a first housing 12A and a second housing 12B. The first housing 12A is configured as an RF shield. The second housing 12B can also be configured as an RF shield. As explained in more detail below, the housing 12 includes a waveguide filter channel 16, as shown in FIGS. 5 and 6. More specifically, the first housing 12A integrates portions of the waveguide filter channel 16, such that the waveguide filter channel 16 is enclosed by the first housing 12A and the circuit board 14. Thus, the waveguide filter channel 16 is formed between the circuit board 14 and the first housing 12A, with the circuit board 14 and the first housing 12A each forming at least a portion of the waveguide filter channel 16. By integrating the waveguide filter channel 16 into the first housing 12A (e.g., into an RF shield) as described herein, the % waveguide assembly 10 has a compact design, is simple and inexpensive to construct, uses fewer components than prior designs, and achieves high tolerances to minimize RF signal losses.

The waveguide assembly 10 includes or is attached to at least one end launch connector 18. The circuit board 14 can include at least one end launch connector 18, or can have at least one end launch connector 18 attached thereto. Here, two end launch connectors 18 are mounted at opposite ends of the circuit board 14. The end launch connectors 18 are configured to transition microwave energy from a coaxial cable to a circuit on the circuit board 14, and/or vice versa. Here, a first end launch connector 18A is attached at a first end 14*a* of the circuit board 14, and a second end launch connector 18B is attached at an opposite second end 14*b* of the circuit board 14. The end launch connectors 18 are configured to connect a coaxial cable (not shown) to the circuit board 14. Here, the first end launch connector 18A is an input end launch connector which receives an input coaxial cable (e.g., threaded onto the end threads), and the second end launch connector 18B is an output end launch connector which receives an output coaxial cable (e.g., threaded onto the end threads). Either of the first and second end launch connectors 18A, 18B can be an input end launch connector, an output end launch connector, or can function as both an input and an output end launch connector.

Figure 2:
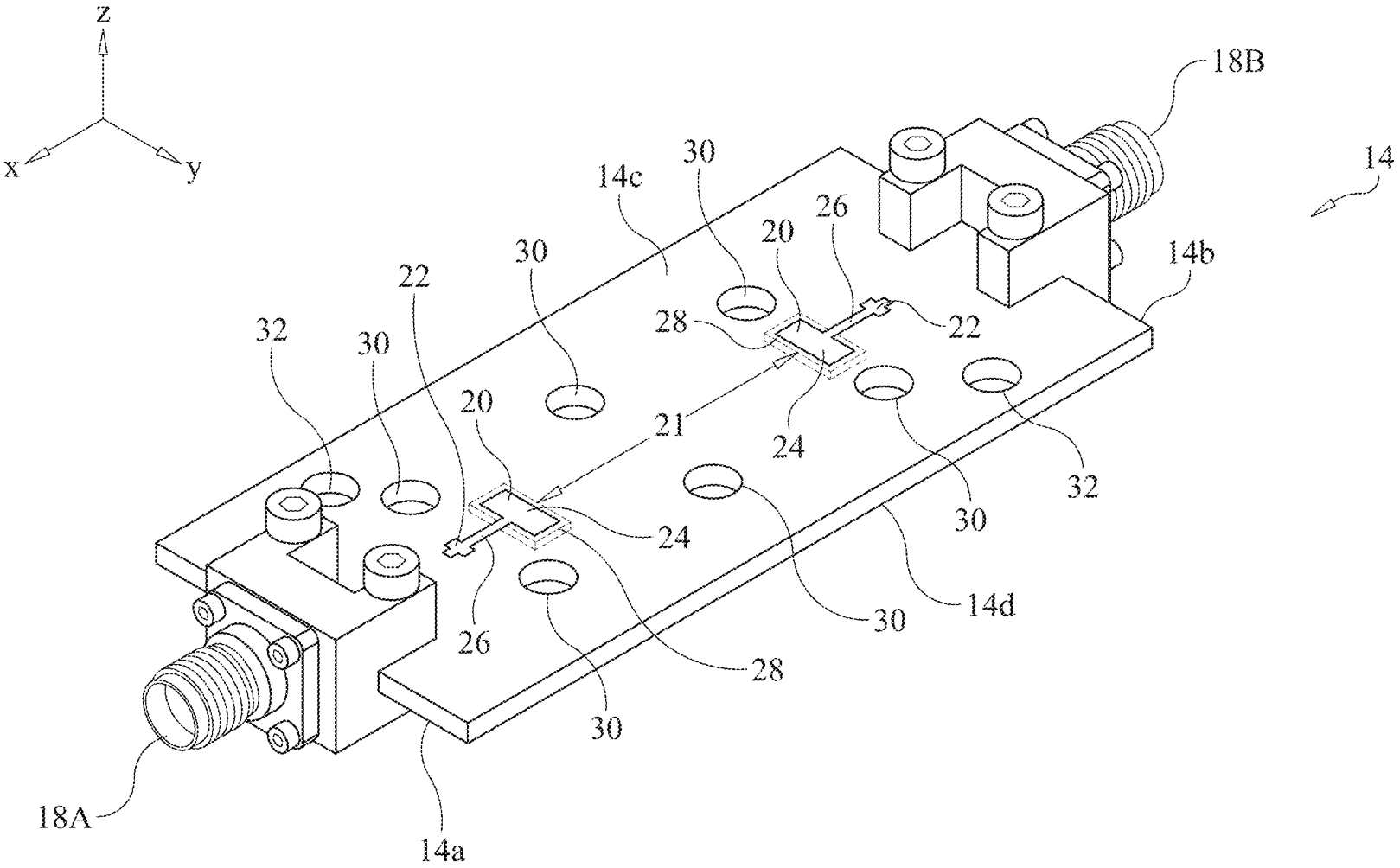
FIG. 2 illustrates a top perspective view of an example embodiment of a circuit board of the waveguide assembly of FIG. 1.
Figure 3:
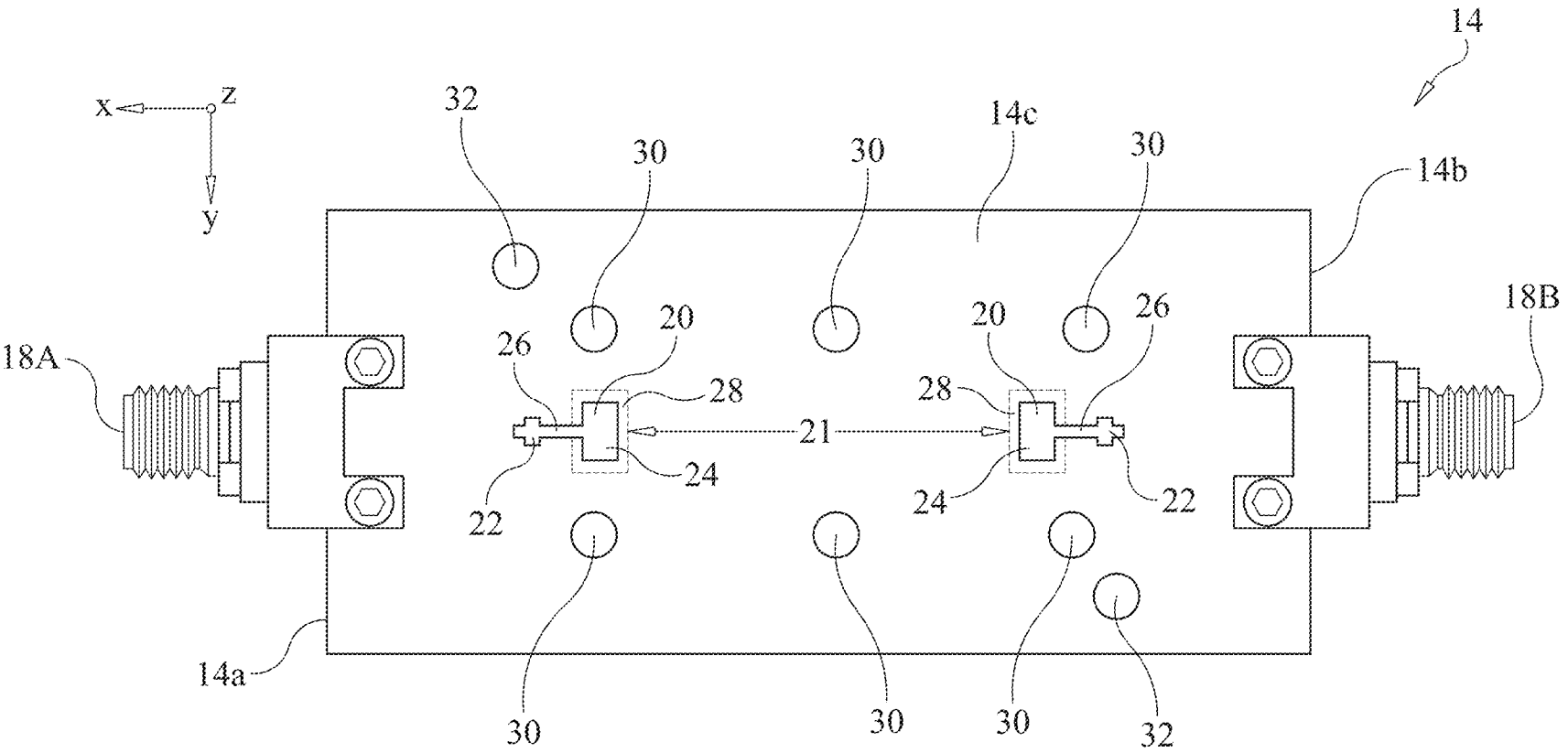
FIG. 3 illustrates a top plan view of the circuit board FIG. 2.

FIGS. 2 and 3 show the circuit board 14 in more detail. Here, the circuit board 14 is a printed circuit board. Although illustrated as single piece, the circuit board 14 is generally made using multiple layers which are stacked in the z-direction. Using the coordinate system provided in the figures, a first layer 14*c* would be the top layer in the z-direction, a second layer 14*d* would be the bottom layer in the z-direction. As can be understood, the circuit board 14 can include one or more intermediate layers between the top layer 14*c* and the bottom layer 14*d* in the z-direction, if desired. The first layer 14*c*, second layer 14*d* and/or intermediate layers can be sheet layers of non-conductive substrate. As should be understood by those of ordinary skill in the art from this disclosure, the circuit board 14 can have conductive tracks, pads and/or other features printed or placed on and/or between the various non-conductive sheet layers.

The circuit board 14 includes at least one waveguide interface 20. The at least one waveguide interface 20 is formed from an electrically conductive material. Each waveguide interface 20 is a zero z-axis patch that functions to transition RF signals from the circuit board 14 to the waveguide filter channel 16 and/or from the waveguide filter channel 16 to the circuit board 14. The at least one waveguide interface 20 is configured to launch an RF signal from the circuit board 14 to the waveguide filter channel 16 in the first housing 12A, or to receive an RF signal from the waveguide filter channel 16 into the circuit board 14.

Here, the at least one waveguide interface 20 includes a first waveguide interface 20A and a second waveguide interface 20B. As shown, the first waveguide interface 20A is separated from the second waveguide interface 20B on the surface of the circuit board 14. The first waveguide interface 20A is configured to launch an RF signal from the circuit board 14 to the waveguide filter channel 16, and the second waveguide interface 20B is configured to receive the RF signal from the waveguide filter channel 16 back into the circuit board 14. Thus, the waveguide filter channel 16 is configured to receive an RF signal from the first waveguide interface 20A and output the RF signal to the second waveguide interface 20B. Here, the first waveguide interface 20A and the second waveguide interface 20B are sized and shaped in an identical manner, but the first waveguide interface 20A and the second waveguide interface 20B can also be shaped differently from each other and/or differently than shown. As explained in more detail below, the area 21 of the first layer 14*c* which lies between the first waveguide interface 20A and the second waveguide interface 20B acts as a border for the waveguide filter channel 16 when the waveguide assembly 10 is fully assembled. Thus, the circuit board 14 forms a border of the waveguide filter channel 16 at the area 21. More specifically, the circuit board 14 forms a side surface of the waveguide filter channel 16 that extends between the first waveguide interface 20A and the second waveguide interface 20B.

Each waveguide interface 20 can be formed with an electrically conductive material as a microstrip line with an electrical resistance. For example, each waveguide interface 20 can have a 50 Ohm resistance. Additionally, each waveguide interface 20 can include copper More specifically, each waveguide interface 20 can be formed by printing copper on one side (e.g., the first layer 14*c*) of the circuit board 14. Each waveguide interface 20 can be placed in electrical communication with an end launch connector 18, for example, via electrical communication via the circuit board 14. Here, the first waveguide interface 20A is placed in electrical communication with the first end launch connector 18A, and the second waveguide interface 20B is placed in electrical communication with the second end launch connector 18B.

Figure 9:
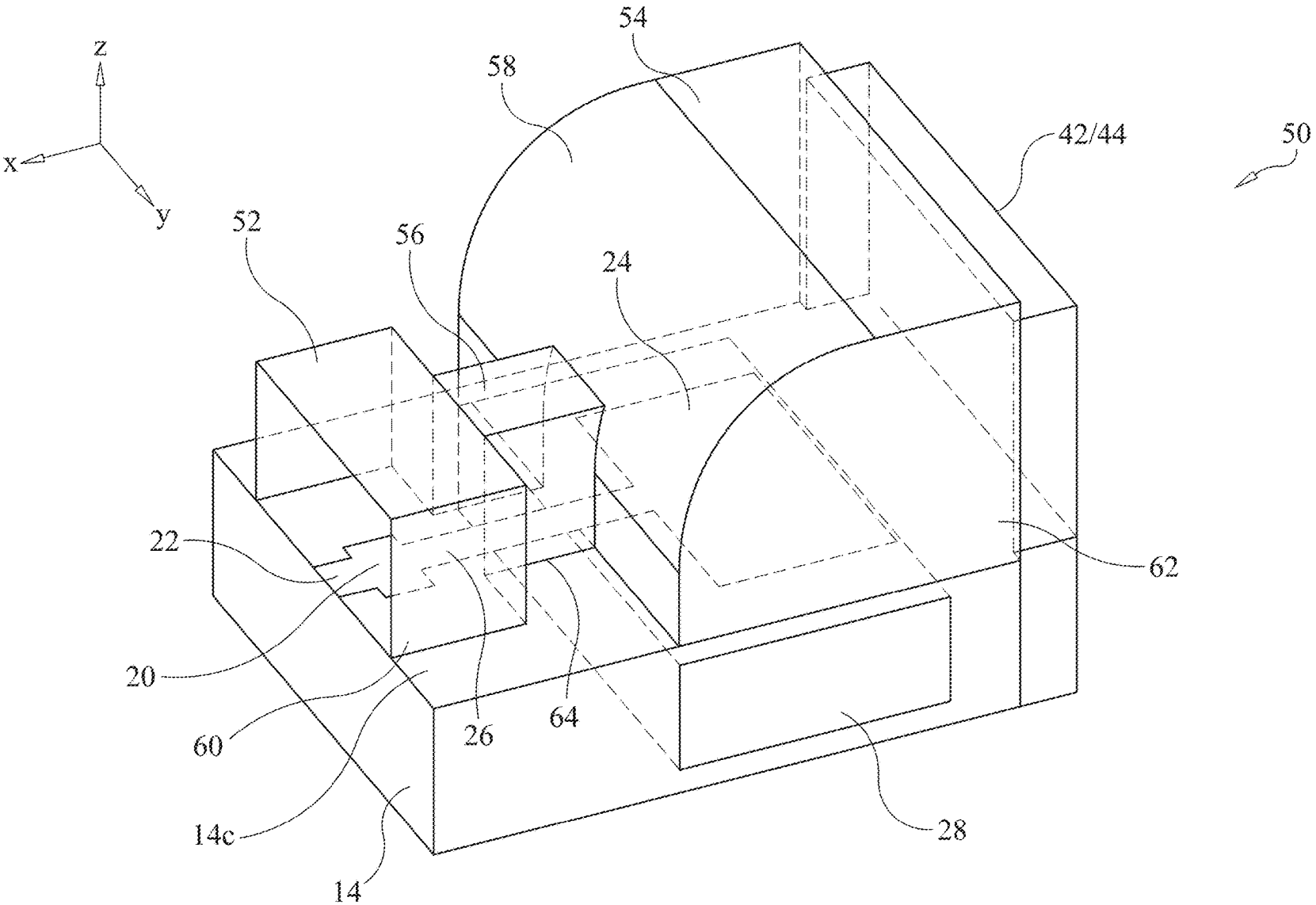
FIG. 9 illustrates an example embodiment of a transition portion of the waveguide filter channel of FIG. 7.
Figure 10:
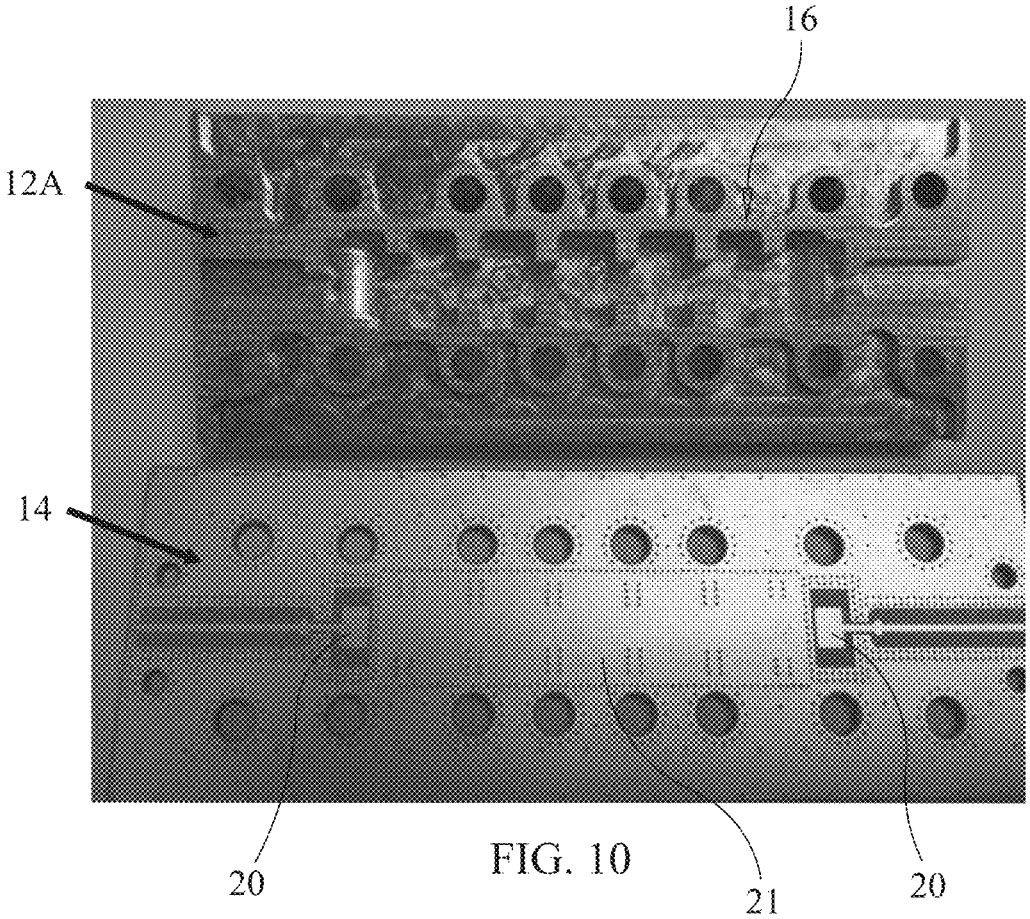
FIG. 10 is a photograph of an example embodiment of components of a waveguide assembly according to the present disclosure.

As illustrated more clearly in FIG. 9, each waveguide interface 20 extends between a first end 22 and a second end 24. The first end 22 is configured to electrically communicate with an end launch connector 18, for example, via electrical communication via the circuit board 14. The second end 24 is a zero z-axis patch that launches the RF signal from the circuit board 14 into the waveguide filter channel 16, or receives the RF signal from the waveguide filter channel 16 into the circuit board 14, as explained in more detail below. Here, the first end 22 is sized and shaped to have a smaller surface area than the second end 24. The smaller first end 22 is closer to the outer edge of the circuit board 14 than the larger second end 24. Although not shown in FIG. 9, FIG. 10 illustrates that the first end 22 can extend to the edge of the circuit board 14 in the x-direction. The first end 22 can be connected to the second end 24 by a narrow strip 26. The narrow strip 26 places the first end 22 in electrical communication with the second end 24. The narrow strip 26 is narrower than the first end 22 or the second end 24 in the y-direction. Here, the first end 22 is formed as a cross, the second end 24 is formed as a square, and the narrow strip 26 is formed as a longitudinally extending rectangle. It should be understood from this disclosure that the sizes and shapes of the first end 22, the second end 24 and the narrow strip 26 will vary, for example, depending on the intended function of the waveguide assembly 10 (e.g., due to the types of RF signals being transmitted).

The circuit board 14 also includes at least one air cavity 28. The at least one air cavity 28 is aligned with the at least one waveguide interface 20 in the z-direction. More specifically, the at least one air cavity 28 overlaps with the second end 24 of the at least one waveguide interface 20 in the z-direction. Here, the at least one air cavity 28 includes a first air cavity 28A and a second air cavity 28B. The first air cavity 28A is aligned with the first waveguide interface 20A in the z-direction. Thus, the first air cavity 28A overlaps with the first waveguide interface 20A in the z-direction. The second air cavity 28B is aligned with the second waveguide interface 20B in the z-direction. Thus, the second air cavity 28B overlaps with the second waveguide interface 20B in the z-direction.

In FIGS. 2 and 3, each air cavity 28 is shown in broken lines to show the location within the circuit board 14. This is to show that each air cavity 28 is located below the first layer 14*c*, with each waveguide interface 20 printed on the first layer 14*c* in the alignment shown. FIG. 9 shows a portion of the first layer 14*c* below the illustrated waveguide interface 20, showing how the waveguide interface 20 is printed on the first layer 14*c* to overlap with the air cavity 28 in the z-direction. As shown, the first layer 14*c* lies between the waveguide interface 20 and the air cavity 28 in the z-direction. It should also be understood from this disclosure that the second layer 14*d* can be positioned below the air cavity 28, such that the air cavity 28 is enclosed within the circuit board 14 between the first layer 14*c* and the second layer 14*d*. Thus, in an embodiment, the air cavity 28 is formed as an aperture in one or more intermediate layers between the top layer 14*c* and the bottom layer 14*d* in the z-direction, and is enclosed within the circuit board 14, for example, by the first layer 14*c* and the second layer 14*d* and/or additional layers. In another embodiment, the air cavity 28 can pass through the second layer 14*d* and can be enclosed by the first layer 14*c* and the second housing 12B when the waveguide assembly 10 is fully constructed as shown in FIG. 1.

The circuit board 14 also includes at least one fixing aperture 30, 32. Here, the circuit board 14 includes a plurality of fixing apertures 30, 32. The fixing apertures 30, 32 allow the circuit board 14 to attach to the housing 12 via corresponding fixing apertures 34, 36 in the housing 12, for example, via fastening devices 38 which align and/or attach the circuit board 14 between the first housing 12A and the second housing 12B.

Figure 4:
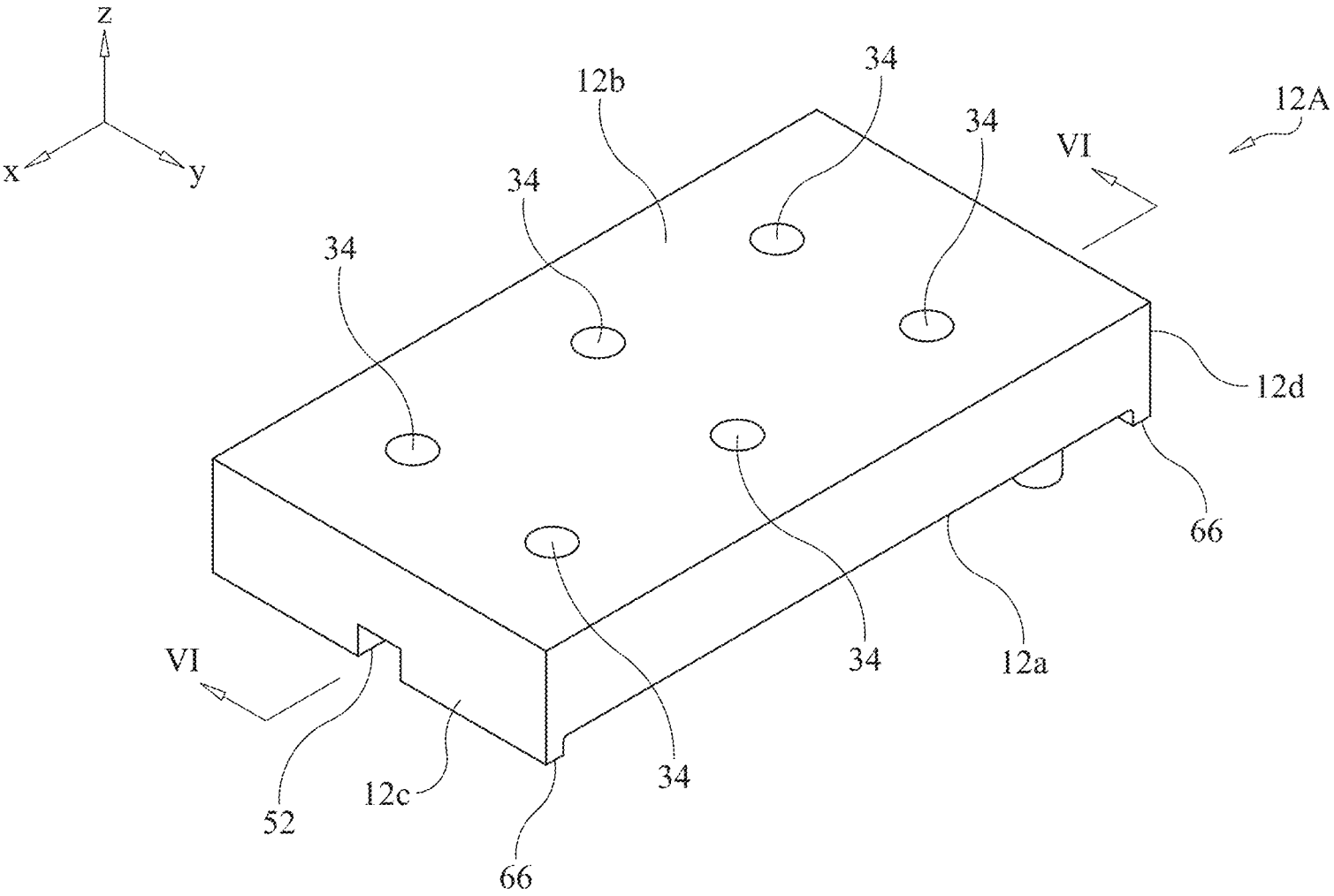
FIG. 4 illustrates a top perspective view of an example embodiment of a first housing of the waveguide assembly of FIG. 1.

FIGS. 4 to 6 show the housing 12 in more detail. More specifically, FIGS. 4 to 6 illustrate the first housing 12A of the housing 12 in more detail. The first housing 12A is configured to be attached to the circuit board 14 so as to align with the at least one waveguide interface 20. More specifically, the first housing 12A is configured to be attached to the circuit board 14 such that the waveguide filter channel 16 is aligned with the first waveguide interface 20A and the second waveguide interface 20B to place the first waveguide interface 20A in signal communication with the second waveguide interface 20B such that an RF signal can be transmitted from the first waveguide interface 20A to the second waveguide interface 20B. FIG. 5 also shows the first waveguide interface 20A and the second waveguide interface 20B for reference as to how the first housing 12A aligns with the circuit board 14 when attached as shown in FIG. 1. It should be understood from this disclosure, however, that the first waveguide interface 20A and the second waveguide interface 20B are part of the circuit board 14 in the illustrated embodiment and are shown in other figures for reference only. As used herein, "signal communication" means that an RF signal can be communicated between elements.

In the illustrated embodiment, the length of the first housing 12A is smaller than the length of the circuit board 14 in the x-direction to make room for the end launch connectors 18. The length of the first housing 12A is approximately equal to the length of the circuit board 14 in the y-direction. The height of the first housing 12A is significantly larger than the height of the circuit board 14 in the z-direction. The dimensioning shown enables the first housing 12A to be an RF shield. The dimensions can vary, for example, depending on the intended function of the waveguide assembly 10 (e.g., due to the types of RF signals being transmitted).

The first housing 12A includes an inner side 12*a* and an outer side 12*b*. As seen in FIGS. 5 and 6, the inner side 12*a* of the first housing 12A includes the waveguide filter channel 16. As seen in FIG. 6, the waveguide filter channel 16 is formed by (i.e., integrated into) the inner side 12*a* of the first housing 12A. In other words, the waveguide filter channel 16 is formed as an empty cavity in the z-direction of the inner side 12*a* of the first housing 12A. Thus, the first housing 12A forms at least a portion of a waveguide filter channel 16 therein. Here, the waveguide filter channel 16 extends from the first end 12*c* of the first housing 12A to the second end 12*d* of the first housing 12A (see also FIG. 10). When the first housing 12A is attached to the circuit board 14 as shown in FIG. 1, the inner side 12*a* of the first housing 12A is placed adjacent to the circuit board 14 such that the waveguide filter channel 16 lies between the first housing 12A and the circuit board 14. This configures the waveguide assembly 10 so that the at least one waveguide interface 20 is located between the waveguide filter channel 16 and the at least one air cavity 28. When attached, the circuit board 14 and the housing 12 each form at least a portion of the waveguide filter channel 16. More specifically, the inner side 12*a* forms a first side of the waveguide filter channel 16, and the first layer 14*c* of the circuit board 14 at the area 21 forms an opposite second side of the waveguide filter channel 16. When constructed, the waveguide filter channel 16 is configured to launch or receive an RF signal. More specifically, the waveguide filter channel 16 is configured to at least one of (i) receive an RF signal from the at least one waveguide interface 20 or (ii) output the radio frequency signal to the at least one waveguide interface 20.

Figure 7:
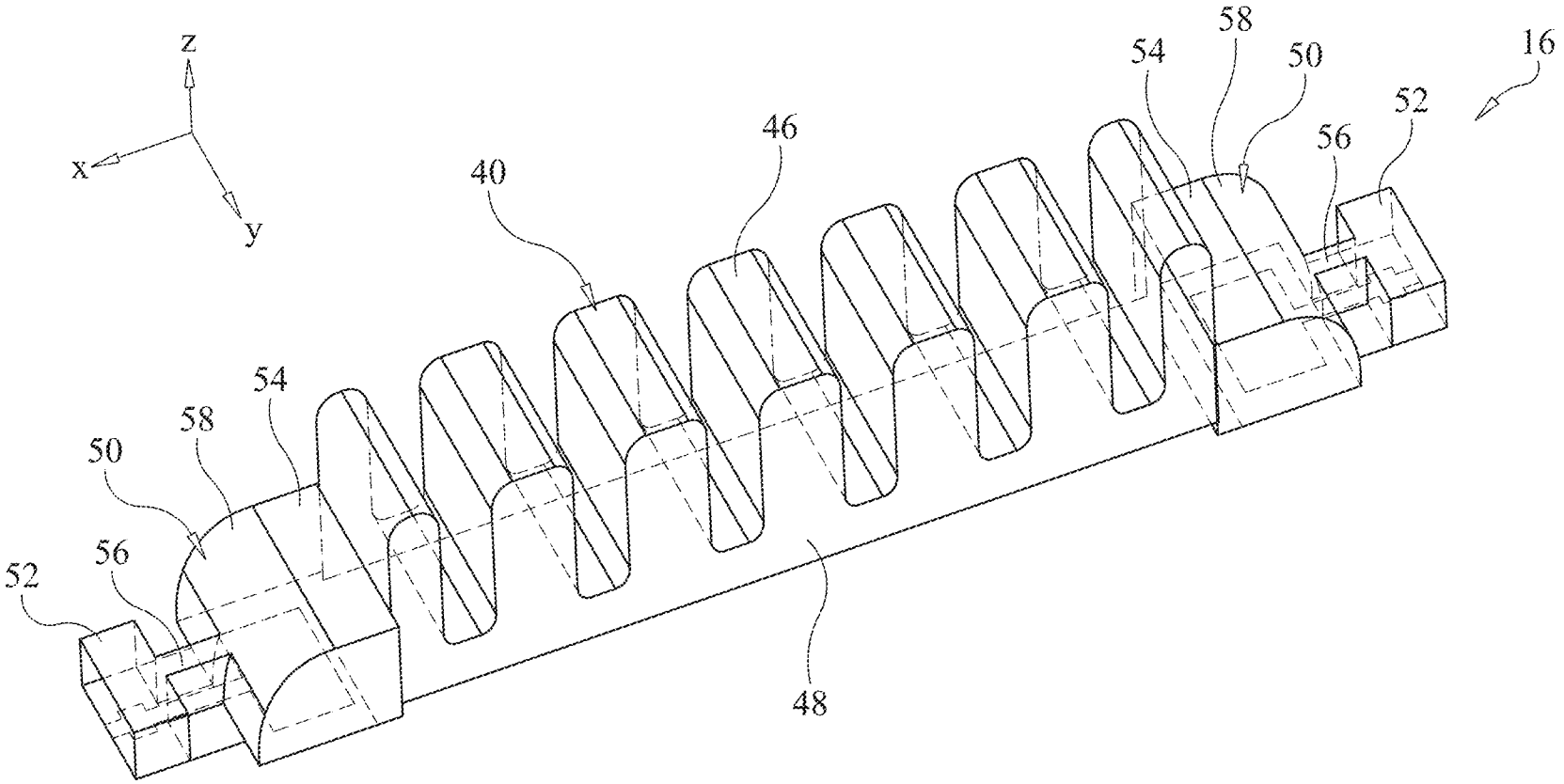
FIG. 7 illustrates a top perspective view of an example embodiment of a waveguide filter channel which can be integrated into the first housing of FIG. 4.

As seen in FIGS. 5 to 7, the waveguide filter channel 16 includes a filter portion 40. The waveguide filter channel 16 also includes at least one transition portion 50. Here, the at least one transition portion 50 includes a first transition portion 50A and a second transition portion 50B. The waveguide filter channel 16 extends from the first transition portion 50A to the second transition portion 50B, with the filter portion 40 located between and connecting the first transition portion 50A to the second transition portion 50B. When the first housing 12A is placed against the circuit board 14, the first transition portion 50A aligns with the first waveguide interface 20A, and the second transition portion 50B aligns with the second waveguide interface 20B. More specifically, the first transition portion 50A overlaps with the second end 24 of the first waveguide interface 20A in the z-direction, and the second transition portion 50B overlaps with the second end 24 of the second waveguide interface 20B in the z-direction. Thus, the first waveguide interface 20A aligns with a first portion of the waveguide filter channel 16 and the second waveguide interface 20B aligns with a second portion of the waveguide filter channel 16.

Figure 8:
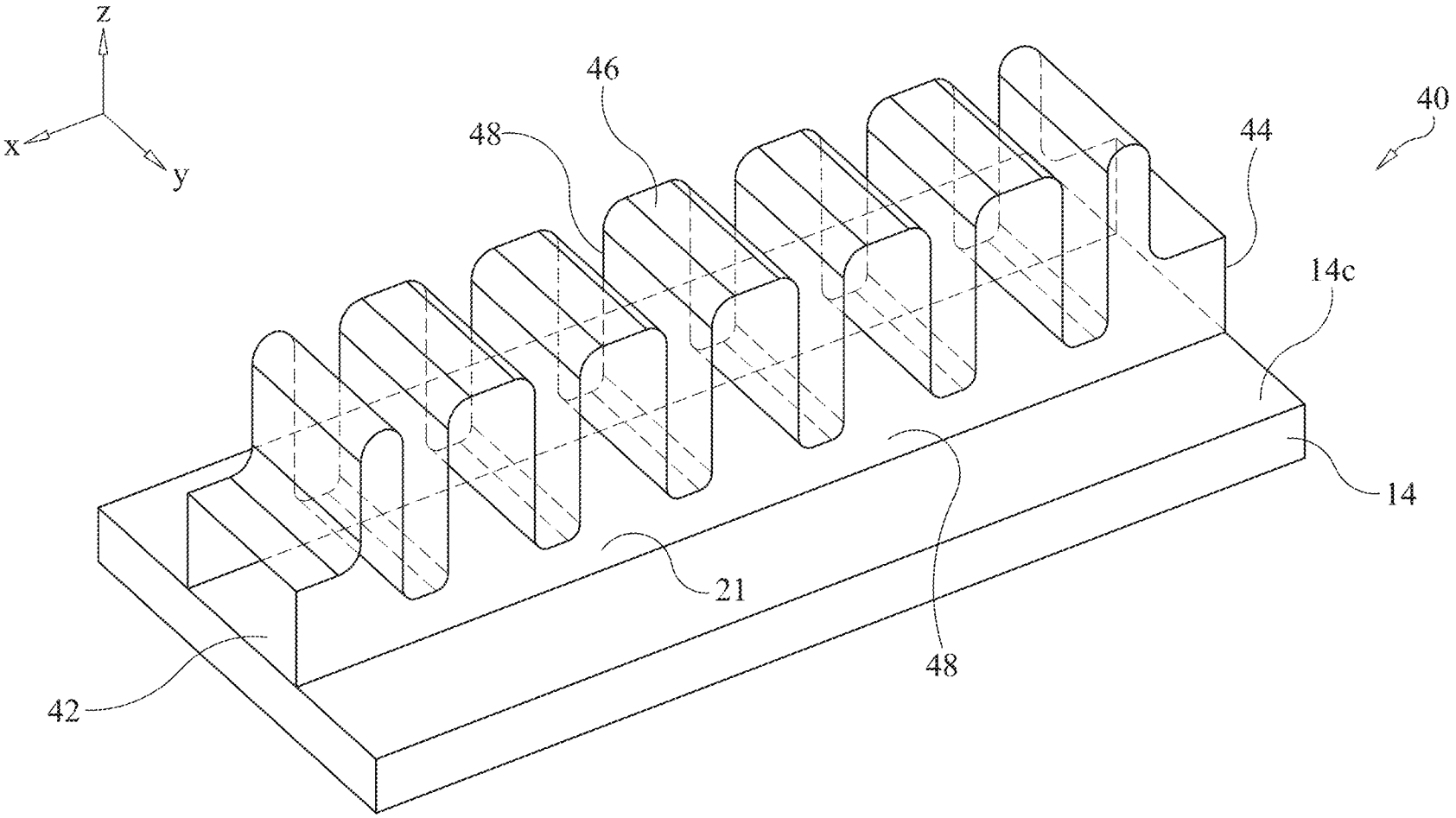
FIG. 8 illustrates an example embodiment of a filter portion of the waveguide filter channel of FIG. 7.

FIG. 8 shows the filter portion 40 of the waveguide filter channel 16 in more detail. The filter portion 40 is formed as an empty cavity in the inner side 12*a* of the first housing 12A. FIG. 8 also shows a portion of the circuit board 14 to illustrate how the filter portion 40 is formed between the first housing 12A and the circuit board 14.

As illustrated, the filter portion 40 extends from an input side 42 to an output side 44. More specifically, the filter portion 40 includes an inner wall 46 and side walls 48 that extend from the input side 42 to the output side 44. When fully formed, the input side 42 has an RF signal input aperture formed by the inner wall 46, the side walls 48 and the circuit board 14, and the output side 44 has an RF signal output aperture formed by the inner wall 46, the side walls 48 and the circuit board 14. Thus, the waveguide filter channel 16 between the input side 42 and the output side 44 is bound by the inner wall 46, the side walls 48 and the circuit board 14. The inner wall 46 of the filter portion 40 has a serpentine shape between the input side 42 to the output side 44. This allows the first housing 12A to form a serpentine side of the waveguide filter channel 16 that controls a frequency of RF signals transmitting therethrough. Thus, the waveguide filter channel 16 includes a filter portion 40 formed by a serpentine surface of the first housing 12A. In an embodiment, the inner wall 46 can have an inner side radius of about 15 mil. The side walls 48 are shown as flat in the z-direction in FIG. 8, but can also be serpentine as seen in FIG. 10. The side walls 48 are placed directly against the first layer 14*c* of the circuit board 14 to enclose the filter portion 40 in the z-direction. The specific dimensions (e.g., shape and size) of the input side 42, the output side 44, the inner wall 46, and/or the side walls 48 will vary depending on the intended function of the waveguide assembly 10 (e.g., due to the types of RF signals being transmitted). Also, in an embodiment, the input side 42 can function as an output or both an input and an output, and the output side 44 can function as an input or both an input and an output. As will be understood by those of ordinary skill in the art from this disclosure, the serpentine shape of the inner wall 46 and/or the side walls 48 controls the RF signal frequency through the filter portion 40 between the first transition portion 50A and the second transition portion 50B.

The filter portion 40 of the waveguide filter channel 16 functions as a waveguide filter to allow RF signals at some frequencies to pass, while rejecting RF signals at other frequencies. In the illustrated embodiment, the shape, size and curvature of the inner wall 46 and/or the side walls 48 regulates the RF frequency. Although the illustrated filter portion 40 is formed as a serpentine waveguide filter, it should be understood from this disclosure that other types of surfaces can also be used to form a filter portion 40 that functions as a waveguide filter to allow RF signals at some frequencies to pass, while rejecting RF signals at other frequencies.

FIG. 9 shows a transition portion 50 in more detail. The transition portion 50 is an empty cavity in the inner side 12*a* of the first housing 12A. Thus, as described herein, each section of the transition portion 50 should be understood to be an empty cavity in the inner side 12*a* of the first housing 12A. FIG. 9 also shows a portion of the circuit board 14 to illustrate how the transition portion 50 aligns with a waveguide interface 20 and an air cavity 28. As shown, the waveguide interface 20 is located between the transition portion 50 and the air cavity 28 in the z-direction. Both the first transition portion 50A and the second transition portion 50B can be formed as shown in FIG. 9.

The transition portion 50 includes a first end section 52 and a second end section 54 on opposite sides in the x-direction. The first end section 52 aligns with the first end 22 of the waveguide interface 20 in the z-direction. Thus, the first end section 52 overlaps with the first end 22 of the waveguide interface 20 in the z-direction. Although not shown in FIG. 9. FIGS. 4, 5 and 10 show that the first end section 52 can extend to the first side 12*c* or the second side 12*d* of the first housing 12A. The second end section 54 aligns with the second end 24 of the waveguide interface 20 in the z-direction. Thus, the second end section 54 overlaps with the second end 24 of the waveguide interface 20 in the z-direction. In the illustrated embodiment, the first end section 52 is narrower than the second end section 54 in the y-direction. The first end section 52 is also narrower than the second end section 54 in the z-direction. The transition portion 50 also includes an intermediate section 56 between the first end section 52 and a second end section 54 in the x-direction. The intermediate section 56 is narrower in the y-direction than the first end section 52 or the second end section 54. The intermediate section 56 aligns with the narrow strip 26 of the waveguide interface 20 in the z-direction. Thus, the intermediate section 56 overlaps with narrow strip 26 of the waveguide interface 20 in the z-direction.

The transition portion 50 is configured to transition the RF signal orthogonally when received from or transmitted to the at least one waveguide interface 20. The second end section 54 places the transition portion 50 in signal communication with the filter portion 40 at either the input side 42 or the output side 44 of the filter portion 40. The inner surface 58 of the transition portion 50 at the second end section 52 is curved to facilitate the transition of an RF signal between the waveguide interface 20 and the filter portion 40 of the waveguide filter channel 16. More specifically, at an input of the waveguide filter channel 16, the RF signal is launched from the second end 24 of the first waveguide interface 20A in the z-direction (e.g., vertically), and the second end section 54 causes the RF signal to change to the x-direction (e.g., horizontally) for entering the filter portion 40. Likewise, at an output of the waveguide filter channel 16, the RF signal is output from the filter portion 40 in the x-direction (e.g., horizontally), and the waveguide interface 20 causes the RF signal to change to the z-direction to be received by the second end 24 of the second waveguide interface 20B. Thus, the transition portion 50 is configured to cause an orthogonal (e.g., 90 degree) bend of the RF signal direction at the input or the output.

The sidewalls 60 of the first end section 52, the sidewalls 62 of the second end section 54, and the sidewalls 64 of the intermediate section 56 are generally straight in the z-direction in the embodiment shown. The sidewalls 60, 62 and/or 64 extend downwardly in the z-direction so as to be placed directly against the first layer 14*c* of the circuit board 14 to enclose the transition portion 50 in the z-direction. As will be understood by those of ordinary skill in the art from this disclosure, the size and/or shape of the transition portion 50 will vary depending on the intended function of the waveguide assembly 10 (e.g., due to the types of RF signals being transmitted). As seen in FIGS. 4, 5 and 10, a continuous sidewall 66 can include one or more of the sidewalls 60, 62 and/or 64 of the transition portion 50 and the sidewalls 48 of the filter portion 40. Thus, the continuous sidewall 66 can extend downwardly in the z-direction so as to be placed directly against the first layer 14*c* of the circuit board 14 to enclose the waveguide filter channel 16 in the z-direction.

The first housing 12A also includes at least one fixing aperture 34, 36. Here, the first housing 12A includes a plurality of fixing apertures 34, 36. The fixing apertures 34, 36 allow the first housing 12A to attach to the circuit board 14. More specifically, the fixing apertures 34, 36 allow the first housing 12A to attach to the circuit board 14 via the corresponding fixing apertures 30, 32 in the circuit board 14, for example, via fastening devices 38 which align and/or attach the circuit board 14 between the first housing 12A and the second housing 12B.

The first housing 12A can be made of any suitable material, for example, zinc, aluminum or plastic. The first housing 12A can be formed using any suitable method, for example, by injection molding. The features of the waveguide filter channel 16 which are on the inner surface of the first housing 12A can be made at the time that the first housing 12A is formed, or can be formed into the first housing 12A (e.g., by a machining process) after initial formation of the block that will be the first housing 12A.

In the illustrated embodiment, the second housing 12B is a flat block. Like the first housing 12A, the second housing 12B can be made of any suitable material and can be formed using any suitable method. The second housing 12B provides free space to include additional components of the waveguide assembly 10. The second housing 12B can also include any of the features of the first housing 12A.

Construction of the waveguide assembly 10 is simple using relatively few parts. After the first housing 12A and the circuit board 14 are formed as shown, the fixing apertures 30, 32 in the circuit board 14 can be aligned with the fixing aperture 34, 36 of the first housing 12A. The second housing 12B can be simultaneously attached in the same way on the other side of the circuit board 14. Fastening devices 38 (e.g., screws, bolts, etc.) can be placed through the fixing apertures 30, 32, 34, 36 and tightened until the first housing 12A presses against the circuit board 14 to enclose the waveguide filter channel 16 in the z-direction Other attachment methods are also possible. For example, the first housing 12A can be clamped to the circuit board 14 and/or the second housing 12B.

Once fully constructed, the waveguide assembly 10 can be used to transmit and/or control a microwave signal. For example, the first end launch connector 18A receives a microwave signal. The second end 24 of the first waveguide interface 20A is then triggered to launch an RF signal in the z-direction. The first transition portion 50A of the waveguide filter channel 16 transitions the RF signal orthogonally to the x-direction. The filter portion 40 of the waveguide filter channel 16 controls the RF signal at a desired frequency in the x-direction. The second transition portion 50B of the waveguide filter channel 16 transitions the RF signal orthogonally back to the z-direction. The second end 24 of the second waveguide interface 20B receives the RF signal in the z-direction. The second end launch connector 18B then causes an output microwave signal.

When fully constructed, the waveguide filter channel 16 has borders formed by each of the first housing 12A and the circuit board 14. More specifically, each of the filter portion 40, the first transition portion 50A and the second transition portion 50B have borders formed by each of the first housing 12A and the circuit board 14. The filter portion places the first transition portion 50A in signal communication with the second transition portion 50B. The waveguide filter channel 16 places the first waveguide interface 20A in signal communication with the second waveguide interface 20B. Thus, each of the filter portion 40, the first transition portion 50A and the second transition portion 50B place the first waveguide interface 20A in signal communication with the second waveguide interface 20B.

Figure 11:
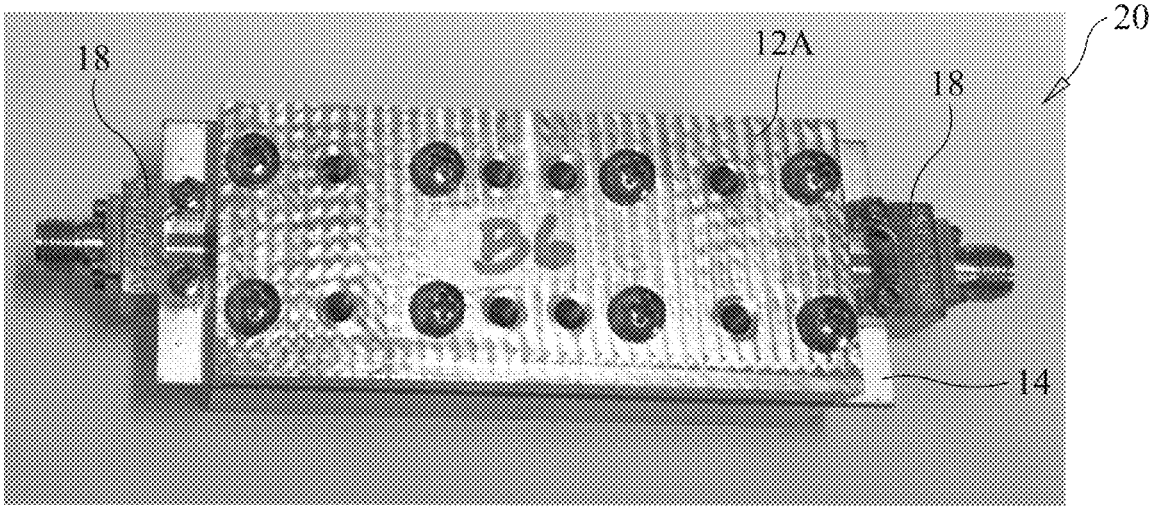
FIG. 11 is another photograph of an example embodiment of components of a waveguide assembly according to the present disclosure.

FIGS. 10 and 11 are photographs of an example embodiment of components of a waveguide assembly 10 according to the present disclosure to show implementation of the principles discussed herein. It should be understood from this disclosure, however, that these are examples only and that there are various ways to implement the principles discussed herein.

The waveguide assembly 10 described herein is an example configured for Ka band frequencies. The waveguide assembly 10 can also be configured for other mm wave and sub mm wave applications. The waveguide assembly 10 can also be configured for Q band frequencies.

The waveguide assembly 10 described herein has improved cut off and insertion loss performance. The waveguide assembly 10 described herein has a compact design, is simple and inexpensive to construct, uses fewer components than prior designs, and achieves high tolerances. It should be understood that various changes and modifications to the systems and methods described herein will be apparent to those skilled in the art and can be made without diminishing the intended advantages.

The embodiments described herein can be employed in, for example, the Jupiter satellite system deployed by Hughes Network Systems or other communication system as understood in the art.

General Interpretation of Terms

In understanding the scope of the present invention, the term "comprising" and its derivatives, as used herein, are intended to be open ended terms that specify the presence of the stated features, elements, components, groups, and/or steps, but do not exclude the presence of other unstated features, elements, components, groups, integers and/or steps. The foregoing also applies to words having similar meanings such as the terms, "including", "having" and their derivatives. Also, the terms "part," "section," or "element" when used in the singular can have the dual meaning of a single part or a plurality of parts.

The term "configured" as used herein to describe a component, section or part of a device includes hardware and/or software that is constructed and/or programmed to carry out the desired function.

While only selected embodiments have been chosen to illustrate the present invention, it will be apparent to those skilled in the art from this disclosure that various changes and modifications can be made herein without departing from the scope of the invention as defined in the appended claims. For example, the size, shape, location or orientation of the various components can be changed as needed and/or desired. Components that are shown directly connected or contacting each other can have intermediate structures disposed between them. The functions of one element can be performed by two, and vice versa. The structures and functions of one embodiment can be adopted in another embodiment. It is not necessary for all advantages to be present in a particular embodiment at the same time. Every feature which is unique from the prior art, alone or in combination with other features, also should be considered a separate description of further inventions by the applicant, including the structural and/or functional concepts embodied by such features. Thus, the foregoing descriptions of the embodiments according to the present invention are provided for illustration only, and not for the purpose of limiting the invention as defined by the appended claims and their equivalents.

What is claimed is:

1. A waveguide assembly comprising:

a circuit board having at least one waveguide interface formed from an electrically conductive material;

a housing including a serpentine inner surface, the housing configured to be attached to the circuit board so as to align with the at least one waveguide interface; and a waveguide filter channel formed between the circuit board and the serpentine inner surface of the housing, with the circuit board and the housing each forming at least a portion of the waveguide filter channel, the waveguide filter channel configured to at least one of (i) receive a radio frequency signal from the at least one waveguide interface or (ii) output the radio frequency signal to the at least one waveguide interface.

2. The waveguide assembly of claim 1, wherein the at least one waveguide interface includes a first waveguide interface aligned with a first portion of the waveguide filter channel and a second waveguide interface aligned with a second portion of the waveguide filter channel, and the waveguide filter channel is configured to receive the radio frequency signal from the first waveguide interface and output the radio frequency signal to the second waveguide interface.

3. The waveguide assembly of claim 2, wherein the circuit board forms a side surface of the waveguide filter channel that extends between the first waveguide interface and the second waveguide interface.

4. The waveguide assembly of claim 1, wherein the housing is configured as a radio frequency shield.

5. The waveguide assembly of claim 1, wherein the waveguide filter channel includes at least one transition portion configured to transition the radio frequency signal orthogonally when received from or transmitted to the at least one waveguide interface.

6. The waveguide assembly of claim 1, wherein the serpentine inner surface is shaped to control a frequency of the radio frequency signal.

7. A waveguide assembly comprising:

a circuit board having at least one waveguide interface formed from an electrically conductive material, the circuit board including at least one air cavity aligned with the at least one waveguide interface;

a housing configured to be attached to the circuit board so as to align with the at least one waveguide interface; and a waveguide filter channel formed between the circuit board and the housing, with the circuit board and the housing each forming at least a portion of the waveguide filter channel, the waveguide filter channel configured to at least one of (i) receive a radio frequency signal from the at least one waveguide interface or (ii) output the radio frequency signal to the at least one waveguide interface.

8. A waveguide assembly comprising:

a circuit board having at least one waveguide interface and at least one air cavity, the at least one waveguide interface formed from an electrically conductive material and configured to launch or receive a radio frequency signal, the at least one air cavity aligned with the at least one waveguide interface; and a housing forming at least a portion of a waveguide filter channel therein, the housing being attached to the circuit board such that the at least one waveguide interface is located between the waveguide filter channel and the at least one air cavity.

9. The waveguide assembly of claim 8, wherein the waveguide filter channel includes at least one transition portion, and the at least one waveguide interface is located between the transition portion and the least one air cavity.

10. The waveguide assembly of claim 9, wherein the at least one transition portion transitions the radio frequency signal orthogonally when received from or transmitted to the at least one waveguide interface.

11. The waveguide assembly of claim 8, wherein the at least one waveguide interface includes a first waveguide interface aligned with a first portion of the waveguide filter channel and a second waveguide interface aligned with a second portion of the waveguide filter channel, the at least one air cavity includes a first air cavity aligned with the first waveguide interface and a second air cavity aligned with the second waveguide interface, and the waveguide filter channel is configured to receive the radio frequency signal from the first waveguide interface and output the radio frequency signal to the second waveguide interface.

12. The waveguide assembly of claim 8, wherein the housing is configured as a radio frequency shield.

13. The waveguide assembly of claim 8, wherein the circuit board forms at least a portion of a side surface of the waveguide filter channel.

14. The waveguide assembly of claim 8, wherein the waveguide filter channel includes a filter portion formed by a serpentine surface of the housing.

15. A waveguide assembly comprising:

a circuit board having a first waveguide interface formed from an electrically conductive material and a second waveguide interface formed from an electrically conductive material, the first waveguide interface separated from the second waveguide interface on a surface of the circuit board; and a housing including a serpentine inner surface, the housing forming at least a portion of a waveguide filter channel therein between the serpentine inner surface and the circuit board, the housing being attached to the circuit board such that the waveguide filter channel is aligned with the first waveguide interface and the second waveguide interface to place the first waveguide interface in signal communication with the second waveguide interface such that a radio frequency signal can be transmitted from the first waveguide interface to the second waveguide interface.

16. The waveguide assembly of claim 15, wherein the first waveguide interface and the second waveguide interface are printed onto the circuit board.

17. The waveguide assembly of claim 16, wherein the first waveguide interface and the second waveguide interface include printed copper.

18. The waveguide assembly of claim 15, wherein the circuit board forms at least a portion of a side surface of the waveguide filter channel.

19. The waveguide assembly of claim 15, wherein the waveguide filter channel includes a filter portion formed by the serpentine inner surface of the housing.

20. A waveguide assembly comprising:

a circuit board having a first waveguide interface formed from an electrically conductive material and a second waveguide interface formed from an electrically conductive material, the first waveguide interface separated from the second waveguide interface on a surface of the circuit board, the circuit board including a first air cavity aligned with the first waveguide interface and a second air cavity aligned with the second waveguide interface; and a housing forming at least a portion of a waveguide filter channel therein, the housing being attached to the circuit board such that the waveguide filter channel is aligned with the first waveguide interface and the second waveguide interface to place the first waveguide interface in signal communication with the second waveguide interface such that a radio frequency signal can be transmitted from the first waveguide interface to the second waveguide interface.

* * * * *